US008292531B2

(12) United States Patent
Rauschert et al.

(10) Patent No.: US 8,292,531 B2
(45) Date of Patent: Oct. 23, 2012

(54) COSMETICS UNIT WITH ADJUSTABLE WIPER

(75) Inventors: Jochen Rauschert, Coburg (DE); Werner Fischer, Burk (DE)

(73) Assignee: Geka GmbH, Bechhofen (DE)

( * ) Notice: Subject to any disclaimer, the term of this patent is extended or adjusted under 35 U.S.C. 154(b) by 442 days.

(21) Appl. No.: 12/604,188

(22) Filed: Oct. 22, 2009

(65) Prior Publication Data

US 2010/0104348 A1 Apr. 29, 2010

(30) Foreign Application Priority Data

Oct. 23, 2008 (DE) ..... 10 2008 052 895

(51) Int. Cl.
*A46B 11/00* (2006.01)

(52) U.S. Cl. ..... 401/129; 401/122; 401/126

(58) Field of Classification Search ..... 401/121, 401/122, 126–130
See application file for complete search history.

(56) References Cited

U.S. PATENT DOCUMENTS

| | | | | |
|---|---|---|---|---|
| 4,194,848 A | | 3/1980 | Kingsford | |
| 4,241,743 A | | 12/1980 | Schnabel et al. | |
| 4,261,376 A | | 4/1981 | Kingsford | |
| 4,407,311 A | * | 10/1983 | Gueret | 401/122 |
| 4,433,928 A | | 2/1984 | Kingsford | |
| 4,609,300 A | | 9/1986 | Robert | |
| 4,705,053 A | * | 11/1987 | Goncalves | 132/218 |
| 6,270,273 B1 | * | 8/2001 | Ohba | 401/122 |
| 6,503,487 B1 | | 1/2003 | Ohba | |

FOREIGN PATENT DOCUMENTS

| | | |
|---|---|---|
| DE | 3513025 C2 | 10/1985 |
| EP | 0219138 A2 | 4/1987 |
| EP | 1714579 B1 | 7/2007 |

* cited by examiner

*Primary Examiner* — David Walczak
(74) *Attorney, Agent, or Firm* — Setter Roche LLP

(57) ABSTRACT

The cosmetics unit comprises a storage container for receiving a cosmetic substance therein, an applicator that can be immersed into the cosmetic substance, and an adjustable wiper part unit disposed on a container opening of the storage container, for wiping off cosmetic substance from the applicator. The wiper part unit comprises a deformable wiper, a neck part, and an adjustment sleeve accessible from the outside. The wiper is disposed between the container opening and the neck part. The adjustment sleeve encloses the container opening, the wiper and, partially, the neck part. The adjustment sleeve is rotatably mounted on the neck part as well as on the storage container, so that an axial distance between the container opening and the neck part, an axial dimension of the wiper, and a surface area of a wiper opening of the wiper can be altered by a rotational movement of the adjustment sleeve.

10 Claims, 5 Drawing Sheets

COSMETICS UNIT WITH ADJUSTABLE WIPER

FIELD OF THE INVENTION

The invention relates to a cosmetics unit, comprising a storage container for receiving a cosmetic substance therein, an applicator that can be immersed into the cosmetic substance, and an adjustable wiper part unit disposed on a container opening of the storage container, for wiping off cosmetic substance from the applicator.

BACKGROUND OF THE INVENTION

Such cosmetics units comprising an adjustable wiper part unit are already known, for example from U.S. Pat. Nos. 4,194,848, 4,241,743, 4,261,376, 4,433,928, 4,609,300, DE 35 13 025 C2 and EP 1 714 579 B1. In the case of these known wipers, a wiper opening can be adjusted in such a way that, when the applicator is pulled through the wiper, a varying amount of cosmetic substance is wiped off so that an amount of the cosmetic substance which is adjustable to some degree remains on the applicator and a variable application can be accomplished.

The wiper opening is varied in different ways in the known adjustable wiper part units. A variant in which the wiper member is twisted is described in U.S. Pat. No. 4,194,848. However, a uniform wiping action is thus not ensured anymore. In another variant, which is also described in U.S. Pat. No. 4,261,376, the position of the wiper member is changed relative to another component also provided with an opening, so that the free wiper opening resulting in total is varied with regard to its surface area. In other designs, which are described, for example, in U.S. Pat. Nos. 4,241,743, 4,433, 928, 4,609, 300 and DE 35 13 025 C2, the wiper member is guided along another guiding component, or such a guiding component is urged against the wiper member so that the result in each case is a change of the surface area of the wiper opening.

In the solutions described in the prior art, it may happen that an adjustment is not possible anymore, especially after extended use and after one and the same size of the wiper opening has been set for some length of time. This may be the result of the cosmetic substance getting stuck on the wiper member and/or of a (partial) loss of resilience of the wiper.

It is thus the object of the invention to provide a cosmetics unit of the type mentioned above which ensures a lasting adjustability of the wiper part unit.

SUMMARY OF THE INVENTION

A cosmetics unit is specified in order to achieve this object. Essential aspects of this cosmetics unit according to the invention are that the wiper part unit is constructed of several separate components, with a firm connection between the lower axial peripheral zone of the wiper with the storage container and the upper axial peripheral zone of the wiper with the neck part being provided nevertheless. In particular, this connection is configured to be so firm that it does not become detached during normal use of the cosmetics unit according to the invention, even after a longer period of use and, above all, even after several adjustments of the wiper part unit. This firm link of the wiper to the two axially adjacent components, i.e. the storage container and the neck part, causes the wiper to be carried along inexorably in the case of a change of the distance between the container opening and the neck part caused by means of the adjustment sleeve, with this guidance having an effect both in the direction of a decreasing distance as well as in the direction of an increasing distance. A lasting adjustability of the cosmetics unit according to the invention is thus provided, even if the wiper part unit has not been adjusted for some time, or if the wiper has lost part of its resilience due to ageing. The guidance provided because of the firm connection with the adjacent components also works in those situations, so that the surface area of the opening of the wiper opening can also be altered even then in the cosmetics unit according to the invention.

The latching groove-latching bead connections described herein constitute a simple, but lastingly effective firm connection between the wiper and the respectively adjacent component, i.e. the storage container and the neck part, respectively.

Because of the throat provided in certain embodiments, the wiper is deformed particularly efficiently especially in the area of the wiper opening if a tractive or compressive force is applied in the axial direction, i.e. in the direction of the central longitudinal axis of the cosmetics unit. The surface area of the wiper opening thus changes as desired. Except for the applicator disposed on the inside and its stem, the throat of the wiper is in no immediate contact, hence free of contact, with any other element of the cosmetics unit, particularly not on the outside of the wiper. In the cosmetics unit according to the invention, a change of the surface area of the wiper opening is generally accomplished without guides, i.e. without any contact with guide components, which in known cosmetics units otherwise cause a change of the wiper opening by means of appropriate resting surfaces. The variation of the surface area of the wiper opening is the result of an inherent deformation in the area of the throat exclusively due to a tractive or compressive force acting axially on the wiper.

The effect of certain embodiments is that the position of the storage container and the neck part relative to each other can only be changed in the axial direction. A relative change in position in the circumferential direction, however, is prevented by the coupling web engaging with the wall recess.

The sleeve thread provided in certain embodiments translates a rotational movement into a longitudinal movement in a simple manner, so that the desired tractive or compressive force can be applied onto the wiper in an axial direction.

Certain embodiments prevent the sleeve thread from overtwisting and thus the cosmetics unit from being destroyed.

The positive guides in certain embodiments ensure that, when the adjustment sleeve is rotated, the neck part is axially displaced upwards or downwards relative to the storage container, independent from the direction of rotation. Thus, the positive guide in particular acts in both directions, that is, in both directions of rotation relative to the adjustment sleeve, and in both axial directions relative to the neck part and the storage container.

Other objects, advantages and details of the invention become apparent from the following description of an exemplary embodiment with reference to the drawings.

BRIEF DESCRIPTION OF THE DRAWINGS

Parts corresponding to one another are provided with the same reference numerals in the FIGS. 1 to 14.

DETAILED DESCRIPTION OF THE PREFERRED EMBODIMENTS

Figure 1:
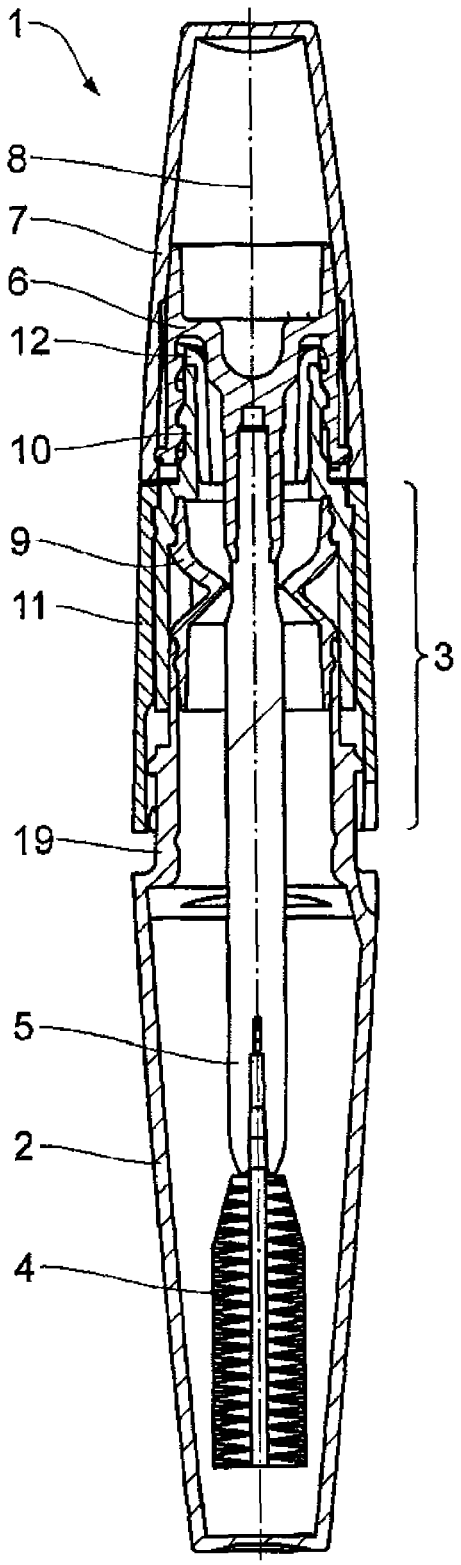
FIGS. 1 and 2 show an exemplary embodiment of a cosmetics unit with an adjustable wiper part unit in a longitudinal cross section and a lateral view, respectively.
Figure 2:
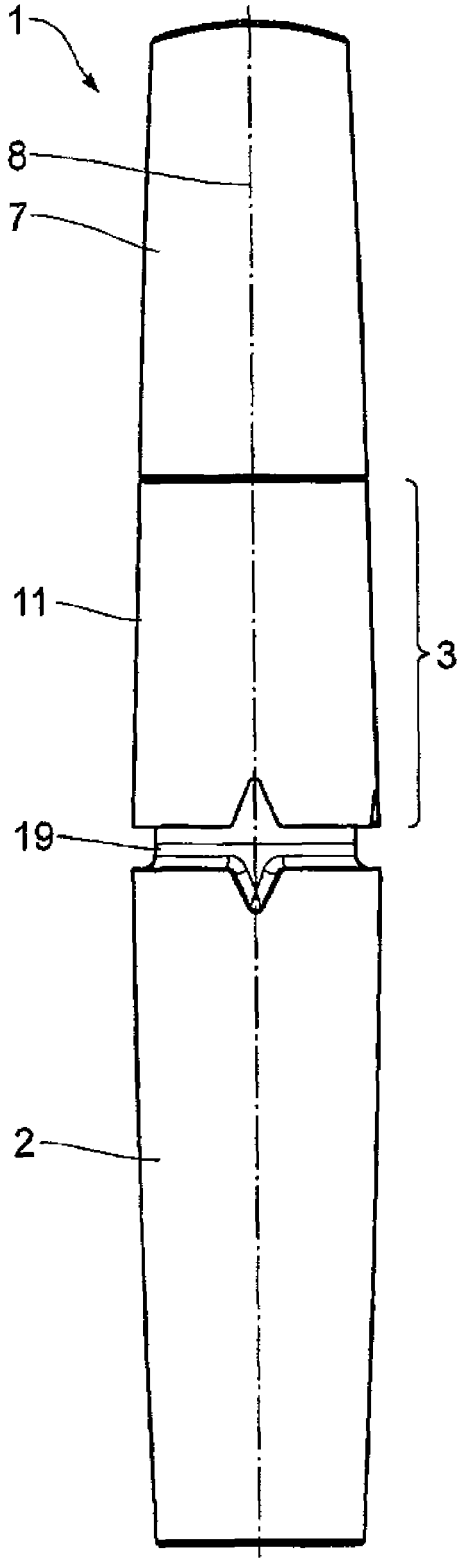

The exemplary embodiment of a cosmetics unit 1 shown in FIGS. 1 and 2 comprises, as main components, a storage container 2 for receiving therein a cosmetic substance not shown in more detail, for example mascara, eyeliner, lip gloss, eye shadow, nail polish or a hair dyeing substance, a wiper part unit 3 and another combined part unit with an applicator 4 connected with a cap 7 by means of an applicator stem 5 and a thread insert 6. On the one hand, the cap 7 serves for closing the storage container 2 and on the other hand also as a handle for handling the applicator 4. The cosmetics unit 1 has a central longitudinal axis 8. The cosmetics unit 1 is fabricated from plastic. The individual components and particularly the storage container 2 can respectively be configured as a blow-molded or injection-molded plastic part.

Figure 3:
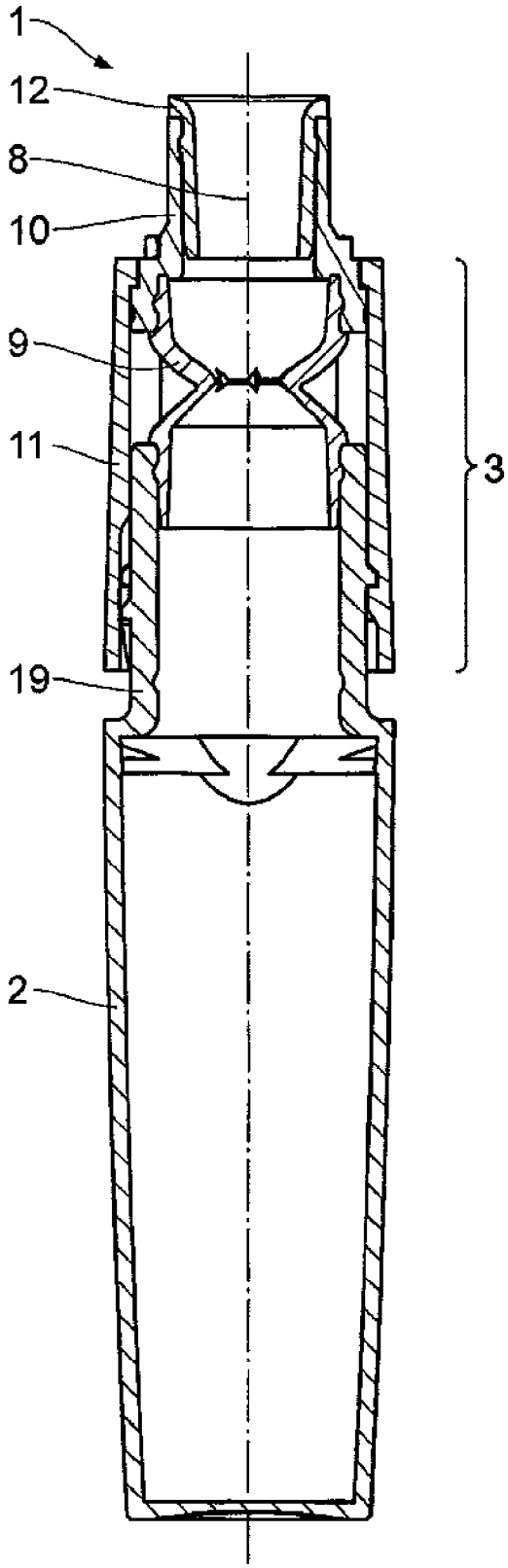
FIG. 3 shows a longitudinal cross section of a storage container with the fitted wiper part unit of the cosmetics unit according to FIGS. 1 and 2.

As is apparent in particular from the longitudinal sectional representation according to FIG. 3, in which the storage container 2 is shown with the fitted wiper part unit 3, the wiper part unit 3 also comprises several separate assembled individual components, namely an elastically deformable wiper 9 as the actual wiper member, a neck part 10, an adjustment sleeve 11 and a sealing member 12 inserted at an upper axial end of the neck part 10. The sealing member, just like the wiper 9, has a certain resilience but is configured independently from the wiper 9. If the cap 7 is fitted, the sealing member 12, in particular with its upper axial circumferential edge, rests closely against the thread insert 6 screwed onto the neck part 10, whereby a secure seal of the cosmetics unit 1 is accomplished and the cosmetic substance filled into the storage container 2 cannot leak out.

Figure 8:
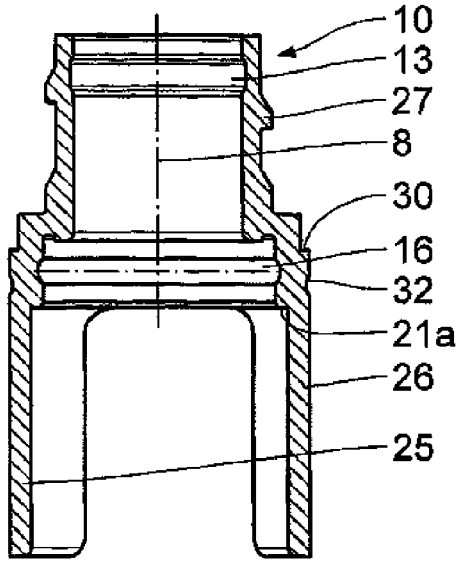

The sealing member 12 also has a hollow-cylindrical appendage which is inserted into an opening of the neck part 10 and is secured there by means of an annular bead latching into an associated annular groove 13 (see FIG. 8) on an inner wall of the opening of the neck part 10.

Figure 12:
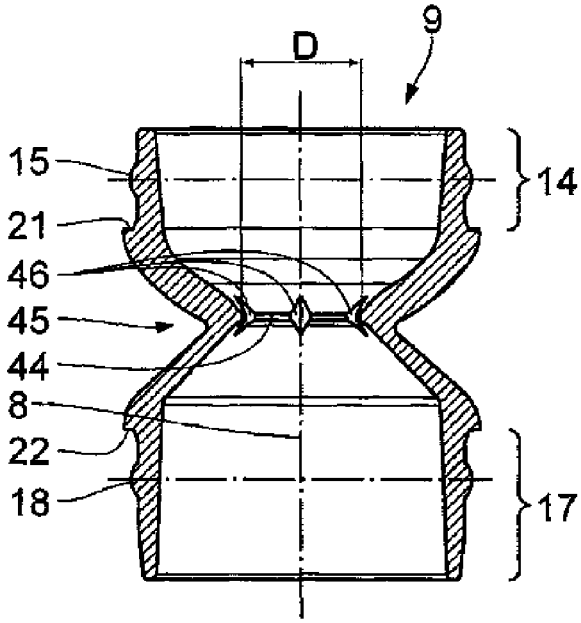

Annular groove-annular bead connections are also provided between the wiper 9 and the storage container 2 as well as the neck part 10. A securing bead 15 extends circumferentially on an upper axial peripheral zone 14 on an outer wall of the wiper 9 (see FIG. 12). In the assembled state, this securing bead 15 latches into a corresponding securing groove 16, which also extends circumferentially and is provided on an inner wall of the neck part 10 (see FIG. 8). A similar connection is also provided on a lower axial peripheral zone 17 of the wiper 9, where another securing bead 18 is provided on an outer wall of the wiper 9 (see FIG. 12). The securing bead latches into a securing groove 20 provide on an inner wall of a container neck 19 (see FIG. 6). In addition, the wiper comprises an upper shoulder 21, which limits the upper axial peripheral zone 14, and which in the assembled state is supported on a circumferentially extending projection 21*a* provided on the inner wall of the neck part 10, as well as a lower shoulder 22, which limits the lower axial peripheral zone 17, and which in the assembled state is supported on an upper edge of the storage container 2 or of the container neck 19 (see FIGS. 3 and 12). On the whole, the result, which is primarily due to the cooperation of the securing beads 15 and 18 with the respectively associated securing groove 16 and 20, respectively, is a firm connection between the wiper 9 and the neck part 10 and the storage container 2, respectively. In particular, this connection is so firm that does not become detached again during normal use of the cosmetics unit 1 after the respective bead-groove interconnection has engaged during assembly.

Figure 6:
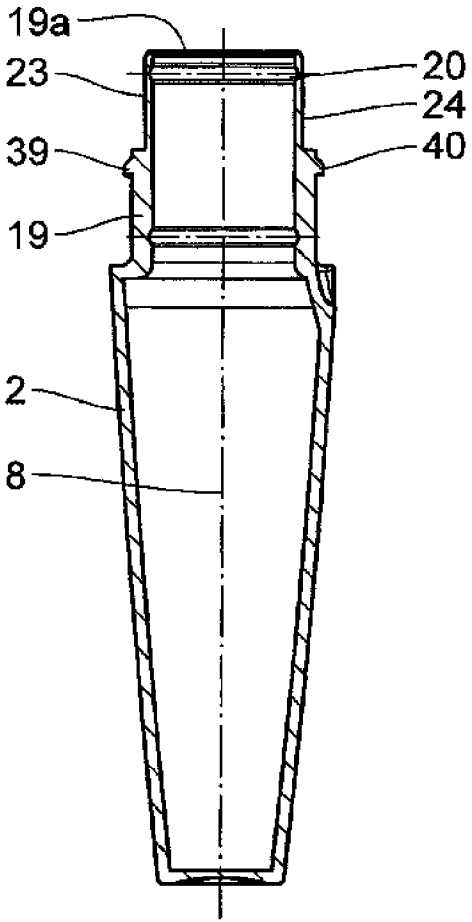
FIGS. 4 to 6 show a storage container of the cosmetics unit according to FIGS. 1 and 2 in two lateral views and a longitudinal cross section, respectively.
Figure 5:
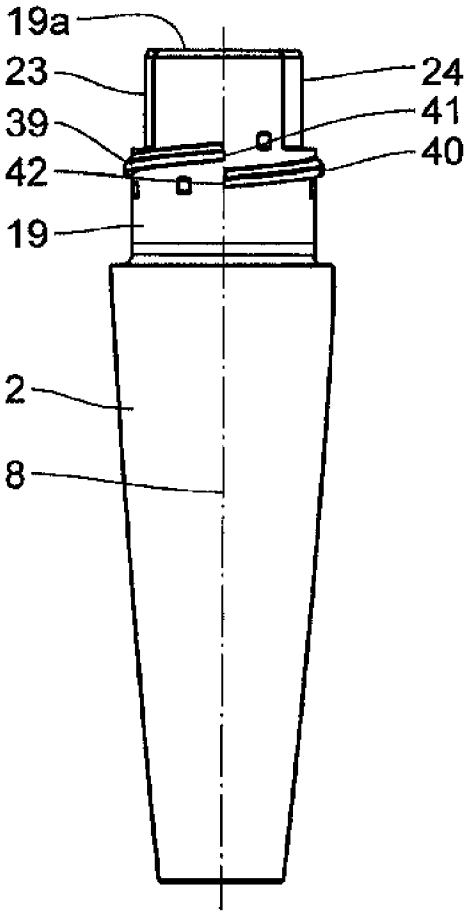
Figure 4:
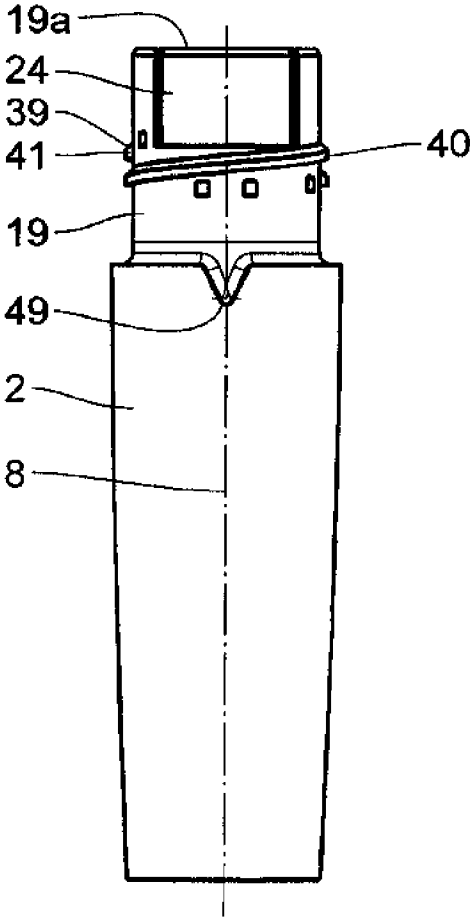

The container neck 19 comprises to wall recesses 23 and 24, which, starting from the axial upper edge or end, on the side of the opening, of the storage container 2 or the container neck 19, respectively, extend downwardly in an axial direction, that is, in the direction of the central longitudinal axis 8, towards the bottom of the container (see FIGS. 4 to 6). The wall recesses 23 and 24 are located opposite from each other. In the lateral view shown in FIG. 4, they have a rectangular cross-sectional contour. They are formed by the container wall being configured, in two annulus sector-shaped portions adjacent to the upper edge of the container neck 19, with a smaller wall thickness than in other areas of the container neck 19. In the radial direction, the wall recesses 23, 24, starting from the outside, protrude a certain extent into the material of the container wall, but a remainder of the wall having the lower wall thickness remains. The storage container 2 thus also stays tightly sealed in the area of the wall recesses 23 and 24 against the escape of the cosmetic substance filled into the storage container 2.

Figure 7:
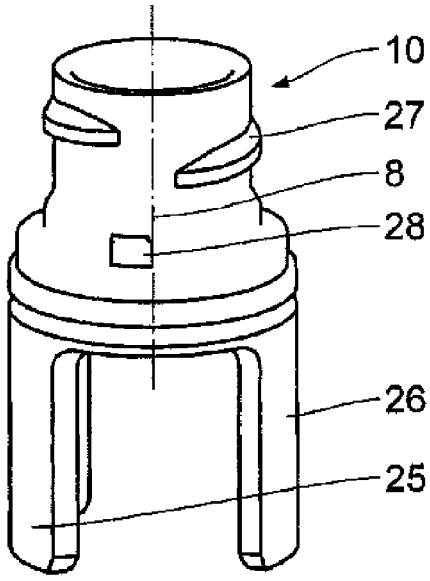
FIGS. 7 and 8 show a neck part of the wiper part unit of the cosmetics unit according to FIGS. 1 and 2 in a perspective view and a longitudinal cross section, respectively.

Two coupling webs 25 and 26, the shape of which is adapted to that of the wall recesses 23 and 24, are formed on the underside of the neck part 10. The coupling webs 25 and 26 extend downwardly in the axial direction on the axial end of the neck part 10 on the side of the wiper (see FIGS. 7 and 8). In the assembled state of the cosmetics unit 1, the two coupling webs 25 and 26 respectively latch into one of the two wall recesses 23 and 24 at least to a certain extent. It is thereby accomplished that the storage container 2 and the neck part 10 can be displaced relative to each other in the axial direction, but not in the circumferential direction. This also provides a guide for the neck part 10.

The neck part 10 is provided in its upper half with an external double thread 27 onto which the thread insert 6, which is firmly inserted into the cap 7 and has a corresponding internal thread, can be screwed. Furthermore, at least one latching projection 28 is also provided in this area which audibly and tangibly snaps into a corresponding latching recess not shown in more detail, when the cap 7 is completely screwed on, which indicates to the user that the cosmetics unit 1 is now closed correctly. Moreover, this latching mechanism (click-close-system) prevents the cosmetics unit 1 from opening by itself.

The adjustment sleeve 11, which is visible and operable from the outside, is rotatably mounted both on the neck part 10 as well as on the container neck 19. In addition to the wiper 9, it establishes another connection between the storage container 2 and the neck part 10. This connection is movable. The adjustment sleeve 11 surrounds a container opening 19*a* of the storage container 2 at the upper edge of the container neck 19 and the wiper 9 and also, at least to some extent, the neck part 10.

Figure 10:
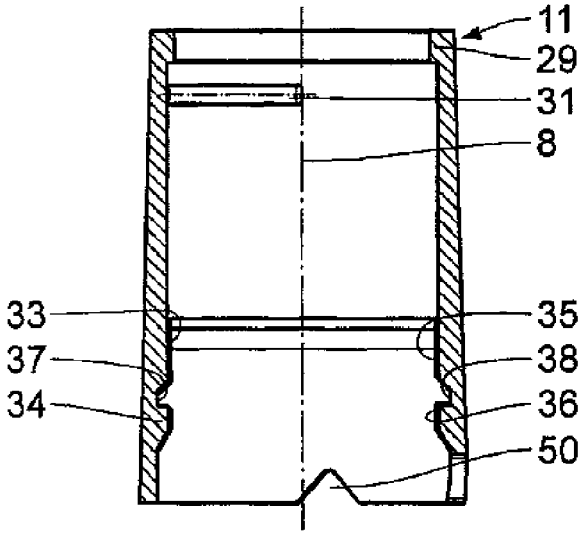

In order to be rotatably mounted on the neck part 10, the adjustment sleeve 11 has on its upper axial edge an inwardly directed annular projection 29 extending circumferentially on the inner wall of the adjustment sleeve 11. In the assembled state, this annular projection 29 rests on a corresponding shoulder 30 which is also provided extending circumferentially on the outside of the neck part 10 (see FIGS. 8 and 10). Moreover, two annulus sector-shaped, in particular quarter-annulus sector-shaped, bead projections 31, of which only one is shown in FIG. 10, are provided in the upper half of the adjustment sleeve 11 on the inner wall below the annular projection 29. The bead projections 31 are disposed, evenly spaced in the circumferential direction, on the inner wall of the adjustment sleeve 11. Basically, a continuous circumferentially extending annular projection can be provided instead of the two bead projections 31. In the assembled state, the two bead projections 31 latch into a groove 32 extending circumferentially on the outer wall of the neck part 10. A positive guide between the adjustment sleeve 11 and the neck part 10 in both axial directions is provided due to the cooperating elements 29 to 32. In this case, the combination of the annular projection 29 and the shoulder 30 exclusively transmits a force directed towards the bottom of the storage container 2 from the adjustment sleeve 11 onto the neck part 10, whereas the combination of the bead projection 31 with the groove 32 acts in both axial directions. Thus, the action of the force that can be exerted by the adjustment sleeve 11 on the neck part 10 in the direction of the bottom of the storage container 2 is larger than that in the opposite direction.

Figure 9:
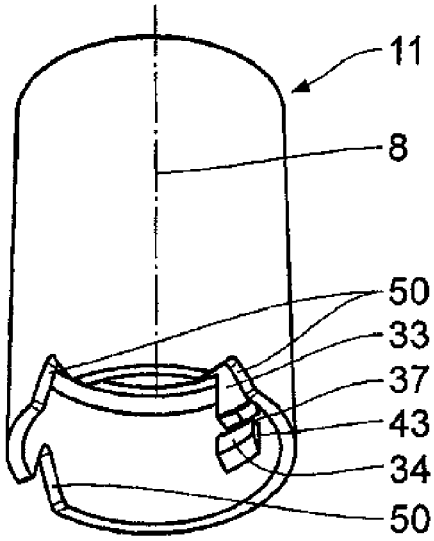
FIGS. 9 and 10 show an adjustment sleeve of the wiper part unit of the cosmetics unit according to FIGS. 1 and 2 in a perspective view and a longitudinal cross section, respectively.

In the lower half, the adjustment sleeve 11 comprises coupling or bearing members intended for coupling with the container neck 19. These are thread projections 33, 34, 35 and 36 protruding on the inner wall, which are disposed in pairs, axially next to each other, and axially separated by a pitch of thread 37 or 38, respectively. The two pairs of thread projections 33 and 34 on the one hand and 35 and 36 on the other hand are disposed offset relative to each other by 180° in the circumferential direction. In the assembled state, threaded segments 39 and 40 of an external thread disposed on the container neck 19 are guided in the thread pitches 37 and 38. As is apparent from FIG. 5, the two threaded segments 39 and 40 are disposed offset relative to each other. They respectively extend over 180° in the circumferential direction. Their end/leading portions are disposed axially one behind the other. Moreover, their flanks 41 and 42, respectively, provided on these end/leading portions are undercut in an oblique manner. The flanks 41, 42 of the threaded segments 39, 40 cooperate with the thread projections 33 to 36 of the adjustment sleeve 11 in such a way that stops for an initial and end rotating position of the adjustment sleeve 11 are provided. In these two end positions, at least one of the flanks 41, 42 rests against a side wall 43 of one of the thread projections 33 to 36. In FIG. 9, the side wall 43 is shown only by way of example for the thread projection 34. Corresponding to the flanks 41, 42, the side wall 43 is also undercut in an oblique manner. Because of these matched oblique undercuts, the stops respectively formed between the thread projections 33 to 36 and the flanks 41, 42 are particularly secure. In this way, the adjustment sleeve 11 is prevented from over-twisting beyond the stops even in case of increased application of force. The undercut angle respectively provided on the flanks 41, 42 and the side walls 43 is, for example, 20°.

The thread projections 33 to 36 are beveled on their side facing the lower axial edge of the adjustment sleeve 11. The threaded segments 39 to 40 of their side facing the upper axial edge of the storage container 2 are also beveled accordingly. Thus, the adjustment sleeve 11 can simply be snapped over the threaded segments 39, 40. Since no comparable beveling is provided on the other sides of the thread projections 33 to 36 and of the threaded segments 39 and 40, the adjustment sleeve 11 cannot be pulled off from the storage container 2 without being damaged once it has been mounted. Thus, in the axial direction, the adjustment sleeve 11 is firmly but rotatably connected to the storage container 2. Due to the annular projection 29 and the shoulder 30, the same also applies to the connection between the adjustment sleeve 11 and the neck part 10. The engaging thread projections 33 to 36 and threaded segments 39, 40 form a positive guide between the adjustment sleeve 11 and the storage container 2 in both axial directions.

Figure 13:
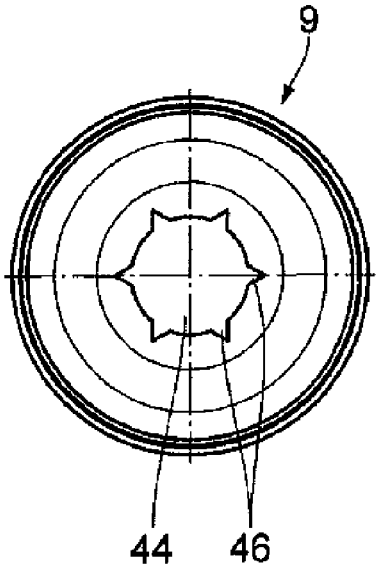

Because of the thread of the sleeve provided between the container neck 19 and the adjustment sleeve 11, a rotational movement of the adjustment sleeve 11 is translated into an axial movement between the storage container 2 on the one hand and the adjustment sleeve 11 as well as the neck part 10 axially coupled with the adjustment sleeve 11 on the other hand. By means of an appropriate twisting of the adjustment sleeve 11, the neck part 10 can in particular be drawn closer to the storage container 2, whereby an axial compressive force is exerted on the wiper 9. With the reduction of the axial distance between the neck part 10 and the storage container 2, the axial dimension of the wiper 9 is also reduced. This results in a change, in particular a decrease in size of a wiper opening 44 formed in the central area of the wiper 9. In this place, the wiper 9 has an annular throat 45 so that the wiper 9 has the approximate shape of a hyperboloid in this area. In the area of the throat 45, the wiper 9 shown in FIGS. 12 and 13 has slits 46 arranged evenly distributed in the circumferential direction, so that the wiper opening 44 has an essentially circular opening area provided with additional jag-shaped recesses on the circumferential edge (see FIG. 13).

Figure 14:
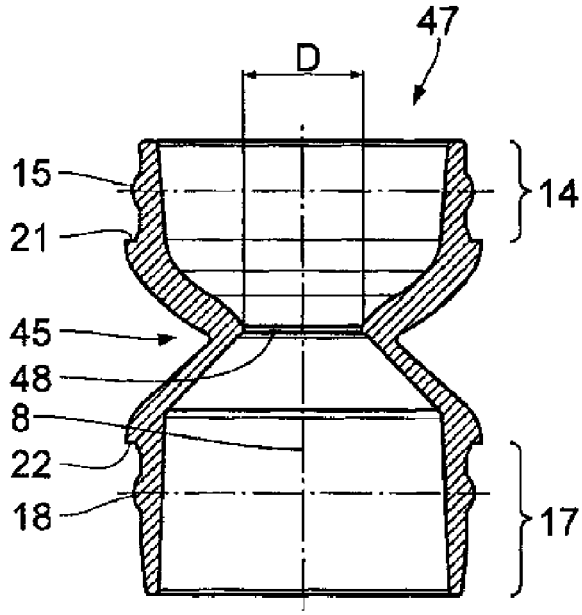
FIG. 14 shows a second exemplary embodiment of a wiper of the wiper part unit of the cosmetics unit according to FIGS. 1 and 2 in a longitudinal cross section.

In principle, other developments of the wiper opening 44 are also possible. In a wiper 47 shown in FIG. 14, which in this regard is configured differently, but substantially identically otherwise, a wiper opening 48 has a round opening area because no slits 46 are provided in the area of the throat 45. Furthermore, other geometric shapes of wiper openings are also possible, such as star-shaped, slotted, etc.

The wipers 9 and 47 consist of a flexible material, such as rubber or silicone. The wipers 9 and 47, in the central area, are not configured completely symmetrical to the plane of the wiper openings 44 and 48, respectively. For instance, the wall thickness of the wiper 9 and 47, respectively, in the area of the throat 45 is larger above the throat 45 than below it. A wiping force is thereby ensured which acts in the opposite direction to the movement of the applicator 4 when the applicator 4 is pulled out. Moreover, the wiper 9 or 47, respectively, extends towards the wiper opening 44 or 48, respectively, with a frustoconical lower portion, whereas the upper portion extending towards the wiper opening 44 or 48, respectively, is configured in a bulged manner, in particular with a curvature towards the outside.

Figure 11:
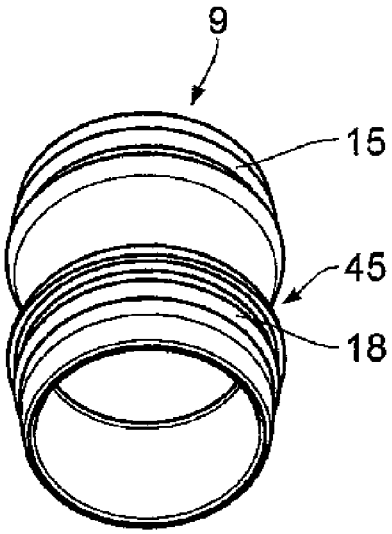
FIGS. 11 to 13 show a first exemplary embodiment of a wiper of the wiper part unit of the cosmetics unit according to FIGS. 1 and 2 in a perspective view, a longitudinal cross section, and a top view from an axial front face, respectively.

The wiper openings 44 and 48 can be altered by means of the mechanism of action already described. The opening area of the wiper opening 44 or 48, respectively, is reduced due to the compression of the wiper 9 or 47, respectively. In the slotted embodiment of the wiper 9, a diameter D of the opening of the wiper opening can be reduced by up to 2.5 mm, in particular by up to 2.2 mm. In a preferred embodiment shown in the FIGS. 11 to 13, the initial value of the opening diameter D, i.e. the diameter value when the wiper 9 is not compressed, is approximately 4.7 mm, whereas the opening diameter at maximum compression of the wiper 9 is only about 2.5 mm.

In the non-slotted embodiment of the wiper 47, the capacity for adjustment for the opening diameter D is approximately 1.5 mm, in particular 0.9 mm or even just 0.8 mm. In this case, there are embodiments in which the opening diameter D can be reduced from 4.7 mm to 3.2 mm, or also from 7.9 mm to 6.4 mm.

If the wiper opening 44 or 48, respectively, is to be enlarged again, this is carried out by twisting back the adjustment sleeve 11. In the process, not only is the compression force applied on the wiper 9 or 47, respectively, reduced. Rather, the wiper 9 or 47, respectively, is actively expanded because of the groove-bead connections by means of the securing beads 15, 18 and the securing grooves 16, 20. This prevents the wiper 9 or 47, respectively, from inadvertently remaining in its compressed position with the narrow opening. In the adjustable cosmetics unit 1, a positive guide of the wiper unit 3 and, in particular, of its components, such as the adjustment sleeve 11 and/or the wiper 9 or 47, respectively, is provided in both axial directions.

The applicator stem 5 has a narrowing portion where the wiper opening 44 or 48, respectively, is disposed in the closed position of the cosmetics unit 1 in order to prevent the wiper 9 or 47, respectively, from expanding or wearing out in an unwanted manner. The narrowing portion of the applicator stem 5 is designed to match the smallest opening diameter D of the wiper opening 44 or 48, respectively, that can be set in each case.

It is conceivable, in principle, to provide only two positions for different wiper openings 44 or 48, respectively, by means of the adjustment sleeve 11. Variants are also possible in which intermediate values can be set, or in which a continuous adjustment of the wiper opening 44 or 48, respectively, is provided. Furthermore, markings 49 or 50, respectively, can be provided on the storage container 2 and/or on the adjustment sleeve 11 in order to provide the user with an indication as to the currently set opening width of the wiper opening 44 or 48, respectively. It is expedient if the maximum rotational travel between the two end positions of the adjustment sleeve 11 is not more than 180°, in particular 160°, and preferably 140°. In that case, it is not necessary to change one's grip when twisting the adjustment sleeve 11. Moreover, the user is able always to keep the markings 49 or 50, respectively, in view. On the whole, a simpler handling is thus possible.

In the cosmetics unit 1, the wiper opening 44 or 48, respectively, can be adjusted in any state of use, that is, both in the case of an opened as well as in the case of a closed cosmetics unit 1. This is always done from the outside by means of the adjustment sleeve 11, which is always accessible. The axial dimension of the gap between the adjustment sleeve 11 and the cap 7 is the same in any position of rotation of the adjustment sleeve 11, so that it can also be determined, for example, whether the cosmetics unit 1 is firmly and, in particular, tightly sealed.

Accordingly, the cosmetics unit is very simple to handle. However, this also applies to manufacture and filling. For example, the cosmetics unit 1 can in principle be filled with any conceivable cosmetic substance. In particular, it is possible in the process already to pre-mount the wiper part unit 3 on the storage container 2 and only then fill it with the respective cosmetic substance. In this case, the filling process can also be carried out, in particular, by means of the conventional filling machines.

The invention claimed is:

1. Cosmetics unit, comprising a) a storage container (2) for receiving a cosmetic substance therein, b) an applicator (4) that can be immersed into the cosmetic substance, and c) an adjustable wiper part unit (3) disposed on a container opening (19*a*) of the storage container (2), for wiping off cosmetic substance from the applicator (4), wherein c1) the wiper part unit (3) comprises, as respectively separate components, a deformable wiper (9; 47), a neck part (10), and an adjustment sleeve (11) accessible from the outside, c2) the wiper (9; 47) is disposed between the container opening (19*a*) and the neck part (10), wherein a lower axial peripheral zone (17) of the wiper (9; 47) is firmly connected with the storage container (2), and an upper axial peripheral zone (14) of the wiper (9; 47) is firmly connected with the neck part (10), c3) the adjustment sleeve (11) surrounds the container opening (19*a*), the wiper (9; 47) and, partially, the neck part (10), and is rotatably mounted on the neck part (10) and on the storage container (2), c4) so that an axial distance between the container opening (19*a*) and the neck part (10), an axial dimension of the wiper (9; 47), and an area of a wiper opening (44; 48) of the wiper (9; 47), which area extends perpendicularly relative to the axial direction, can be altered by means of a rotational movement of the adjustment sleeve (11).

2. Cosmetics unit according to claim 1, characterized in that the lower axial peripheral zone (17) of the wiper (9; 47) and the storage container (2) are connected by means of a latching groove-latching bead connection.

3. Cosmetics unit according to claim 1, characterized in that the upper axial peripheral zone (14) of the wiper (9; 47) and the neck part (10) are connected by means of a latching groove-latching bead connection.

4. Cosmetics unit according to claim 1, characterized in that the wiper (9;

47), in the area of the wiper opening (44; 48), has a throat (45) which is free of contact on its outside.

5. Cosmetics unit according to claim 1, characterized in that a container wall of the storage container (2) has at least one wall recess (23, 24) which, starting from an axial upper end of the storage container (2) on the side of the opening, extends in the axial direction, and that at least one protruding, axially extending coupling web (25, 26), which at least partially latches into the wall recess (23, 24), is provided on the neck part (10), on an axial end thereof on the side of the wiper.

6. Cosmetics unit according to claim 1, characterized in that the adjustment sleeve (11) is mounted either on the storage container (2) or on the neck part (10) by means of a sleeve thread.

7. Cosmetics unit according to claim 6, characterized in that the sleeve thread is attached, as an external thread, to the storage container (2) or to the neck part (10), and comprises two threaded segments (39, 40) offset relative to each other.

8. Cosmetics unit according to claim 7, characterized in that at least one inwardly protruding thread projection (33-36) forming a stop for a flank (41, 42) of at least one of the threaded segments (39, 40) is provided on the adjustment sleeve (11).

9. Cosmetics unit according to claim 1, characterized in that the adjustment sleeve (11) is positively guided on the neck part (10).

10. Cosmetics unit according to claim 1, characterized in that the adjustment sleeve (11) is positively guided on the storage container (10).

* * * * *